US008920582B2

(12) United States Patent
Hikita et al.

(10) Patent No.: US 8,920,582 B2
(45) Date of Patent: Dec. 30, 2014

(54) HEAT-TREATED STEEL MATERIAL, METHOD FOR PRODUCING SAME, AND BASE STEEL MATERIAL FOR SAME

(75) Inventors: Kazuo Hikita, Takarazuka (JP); Nobusato Kojima, Amagasaki (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/591,682

(22) Filed: Aug. 22, 2012

(65) Prior Publication Data

US 2013/0213534 A1 Aug. 22, 2013

Related U.S. Application Data

(63) Continuation of application No. PCT/JP2011/054476, filed on Feb. 28, 2011.

(30) Foreign Application Priority Data

Feb. 26, 2010 (JP) ..... 2010-042309

(51) Int. Cl.

| | |
|---|---|
| ***C22C 38/04*** | (2006.01) |
| ***C22C 38/18*** | (2006.01) |
| ***C22C 38/32*** | (2006.01) |
| ***C22C 38/40*** | (2006.01) |
| ***C22C 38/50*** | (2006.01) |
| ***C22C 38/48*** | (2006.01) |
| ***C22C 38/54*** | (2006.01) |
| ***C21D 8/04*** | (2006.01) |
| ***C21D 8/00*** | (2006.01) |
| ***C22C 38/28*** | (2006.01) |
| ***C22C 38/44*** | (2006.01) |
| ***C22C 38/06*** | (2006.01) |
| ***C21D 8/02*** | (2006.01) |
| ***C22C 38/12*** | (2006.01) |
| ***C22C 38/26*** | (2006.01) |
| ***C22C 38/14*** | (2006.01) |
| ***C22C 38/00*** | (2006.01) |
| ***C22C 38/02*** | (2006.01) |

(52) U.S. Cl.

CPC ..... *C21D 8/005* (2013.01); *C22C 38/54* (2013.01); *C22C 38/04* (2013.01); *C22C 38/28* (2013.01); *C22C 38/44* (2013.01); *C21D 2211/003* (2013.01); *C22C 38/06* (2013.01); *C21D 8/0263* (2013.01); *C22C 38/12* (2013.01); *C22C 38/26* (2013.01); *C21D 8/0226* (2013.01); *C21D 8/0236* (2013.01); *C22C 38/14* (2013.01); *C22C 38/50* (2013.01); *C22C 38/001* (2013.01); *C22C 38/02* (2013.01)

USPC ..... 148/320; 148/330; 148/333; 148/334; 148/335; 148/336; 148/649; 148/654; 148/659; 428/659

(58) Field of Classification Search

USPC ..... 148/320, 333–336, 330, 649, 654, 659; 428/659; 420/104–112

See application file for complete search history.

(56) References Cited

FOREIGN PATENT DOCUMENTS

| | | |
|---|---|---|
| JP | 11-080884 | 3/1999 |
| JP | 2006-283064 | 10/2006 |
| JP | 2007-083304 | 4/2007 |
| JP | 2007-270324 | 10/2007 |
| JP | 2007-270327 | 10/2007 |
| JP | 2008-081823 | 4/2008 |
| JP | 2008-284610 | 11/2008 |

OTHER PUBLICATIONS

Machine-English translation of JP 2007-270324, Yokota Takeshi et al., Oct. 18, 2007.*

* cited by examiner

*Primary Examiner* — Deborah Yee

(74) *Attorney, Agent, or Firm* — Clark & Brody

(57) ABSTRACT

A steel material which is suitable for hot press working or hot three-dimensional bending and direct quench and which can be used to manufacture a high-strength formed article with sufficient quench hardening even by short time heating at a low temperature has a chemical composition comprising, in mass percent, C: 0.05-0.35%, Si: at most 0.5%, Mn: 0.5-2.5%, P: at most 0.03%, S: at most 0.01%, sol. Al: at most 0.1%, N: at most 0.01%, and optionally at least one element selected from the group consisting of B: 0.0001-0.005%, Ti: 0.01-0.1%, Cr: 0.18-0.5%, Nb: 0.03-0.1%, Ni: 0.18-1.0%, and Mo: 0.03-0.5% and has a steel structure in which the spheroidization ratio of carbides is 0.60-0.90.

11 Claims, 3 Drawing Sheets

HEAT-TREATED STEEL MATERIAL, METHOD FOR PRODUCING SAME, AND BASE STEEL MATERIAL FOR SAME

TECHNICAL FIELD

This invention relates to a steel material for undergoing heat treatment, a heat-treated steel material obtained by carrying out heat treatment on the steel material, and a method for manufacturing the heat-treated steel material. A steel material according to the present invention is suitable for applications in which quench hardening is carried out after short time heating, and it is particularly suitable as a material for so-called hot three-dimensional bending and direct quench or hot press working. A heat-treated steel material according to the present invention has a uniformly high strength and good fatigue resistance and toughness even when it is obtained by heat treatment in which quench hardening is carried out after short time heating.

BACKGROUND ART

In recent years, there has been a demand for decreases in the thickness and increases in the strength of structural parts for automobiles out of consideration of global environmental problems and collision safety.

In order to meet this demand, structural parts for automobiles are increasingly using high-strength steel sheet as a base material. However, when structural parts for automobiles are manufactured by press forming of a high-strength steel sheet used as a base material, forming defects in the shape of wrinkles and spring back easily develop. Therefore, it is not easy to manufacture structural parts for automobiles by press forming of high-strength steel sheets.

So-called hot press working is known as a method of solving such problems. hot press working is a method of manufacturing high-strength formed articles by press forming a steel sheet which has been heated to a high-temperature range over 700° C. and then carrying out quench hardening either inside or outside the press dies.

In hot press working, because forming is carried out in a high-temperature region in which the strength of a steel sheet is decreased, the above-described forming defects can be suppressed. Furthermore, it is possible to proved the formed article with a high strength by carrying out quench hardening after forming. Accordingly, hot press working can manufacture formed articles such as structural parts for automobiles having a high strength such as 1500 MPa or above, for example.

Concerning hot press working, Patent Document 1, for example, discloses a steel sheet for hot press forming which is purported to make it possible to carry out successful forming without the occurrence of fractures or cracks at the time of forming by hot press working.

Recently, new techniques are being proposed which make it possible to manufacture high-strength formed articles by methods other than hot press working.

For example, Patent Document 2 discloses a technique for push-through bending of a metal material. In this technique, while the a heating apparatus and a cooling apparatus undergo relative movement with respect to a metal material, the metal material is locally heated by the heating apparatus, and a bending moment is imparted to a location where the resistance to deformation has been greatly decreased by heating so as to perform bending to a desired shape which is bent two-dimensionally or three-dimensionally. Quench hardening is then performed by cooling with the cooling apparatus. (In this description, this technique will be referred to as hot three-dimensional bending and direct quench).

The hot three-dimensional bending and direct quench technique can efficiently manufacture a high-strength formed article with a high bending accuracy. Accordingly, the hot three-dimensional bending and direct quench technique can manufacture formed articles such as structural parts for automobiles having a high strength of the 900 MPa grade or above, for example.

PRIOR ART DOCUMENTS

Patent Documents

Patent Document 1: JP 2006-283064 A
Patent Document 2: JP 2007-83304 A

SUMMARY OF THE INVENTION

In order to guarantee corrosion resistance in the environment of use, structural parts for automobiles are often made of galvanized steel materials having a zinc-based plating or coating(particularly galvannealed steel materials) which are advantageous from a cost standpoint. Therefore, when manufacturing structural parts for automobiles by hot press working or hot three-dimensional bending and direct quench, it is often necessary to use a galvanized steel material as a material being worked.

However, there are problems which need to be solved in order to use galvanized steel materials for hot press working or hot three-dimensional bending and direct quench.

Namely, when a galvanized steel material is used as a material to be worked by hot press working or hot three-dimensional bending and direct quench, the galvanized steel material is heated in air to a temperature of at least 700° C. and typically to a high-temperature region of the $Ac_1$ point or above or even the $Ac_3$ point or above. The vapor pressure of zinc rapidly increases as the temperature rises, as evidenced by the fact that it is 200 mm Hg at 788° C. and 400 mm Hg at 844° C.

Therefore, if a galvanized steel material is heated to the above-described high-temperature region, there is the possibility of most of the zinc-based plating or coating evaporating and being lost. In addition, because heating takes place in the air, oxidation of zinc markedly progresses during the heating, and the anticorrosive function of the zinc-based coating may be lost. Furthermore, if heating is performed to a temperature of at least 600° C. and particularly to a temperature exceeding 660° C. at which F phase ($Fe_3Zn_{10}$) decomposes, there occurs marked dissolution of Zn in the ferrite phase which composes the base steel substrate of the galvanized steel material. Therefore, there is the possibility of most of the zinc-based plating or coating being lost not only by vaporization but by dissolution into the steel substrate to shape a solid solution.

Thus, when a galvanized steel material is used as a material for hot press working or hot three-dimensional bending and direct quench, the steel material obtained by hot press working or hot three-dimensional bending and direct quench (below, this material will be referred to as a "heat-treated steel material" in order to distinguish from the material being worked, which will be referred to as a "steel material"), the zinc-based coating does not sufficiently remain on the surface, or even if the zinc-based coating remains, it loses its anticorrosive function. Therefore, it may not be possible for the zinc-based coating to adequately exhibit its anticorrosive function.

Accordingly, a galvanized steel material which is subjected to hot press working or hot three-dimensional bending and direct quench is desired to have the ability to be quench-hardened sufficiently to manufacture a high-strength formed article even when short time heating is employed such that a zinc-based coating layer can remain as much as possible on the surface of the heat-treated steel material after it has been subjected to hot press working or hot three-dimensional bending and direct quench.

Such ability is not limited to galvanized steel materials, and it is also desired in unplated steel materials which do not have a zinc-based plating or coating. This is because if an unplated steel material is used for hot press working or hot three-dimensional bending and direct quench, scale forms on the surface of the steel material during heating and cooling. Therefore, in a subsequent step, it is necessary to remove the scale by shot blasting or by pickling. If an unplated steel material can be quench-hardened sufficiently to manufacture a formed article having a high strength by short time heating at a low temperature, it is possible to effectively suppress the formation of the above-described scale, and the costs required for descaling can be decreased.

Accordingly, there is also a desire for an unplated steel material to be subjected to hot press working or hot three-dimensional bending and direct quench to be quench-hardened sufficiently to manufacture a formed article having a high strength by short time heating at a low temperature so as to decrease the formation of scale on the surface of a heat-treated steel material which is observed after carrying out hot press working or hot three-dimensional bending and direct quench.

The present invention is intended to solve the above-discussed problems of the prior art, and its object is to provide a steel material having the ability of being quench-hardened sufficiently to manufacture a high-strength formed article by short time heating at a low temperature, thereby making it suitable for use as a material to be worked by hot press working or hot three-dimensional bending and direct quench.

Another object of the present invention is to provide a heat-treated steel material using this steel material and a method for its manufacture.

As a result of detailed investigations by the present inventors aimed at solving the above-described problems and concerning hardenability by short time heating, they discovered the following new problems.

Namely, as a result of the strengthening of a heat-treated steel material by the strengthening ability of carbides which do not adequately dissolve into solid solution during a heating step and are present in an undissolved state, in spite of dissolving of carbides during the heating step being inadequate, a heat-treated steel material sometimes exhibits a maximum hardness. In this case, it was found that even if a heating temperature which provides a maximum hardness is employed, dissolving of carbides during the heating step becomes inadequate, and various problems sometimes develop due to this inadequate dissolving of carbides.

For example, in the case of hot press working in which quench hardening takes place inside press dies, the cooling rate is relatively low. Therefore, it is relatively easy to achieve good toughness by utilizing the self tempering effect. However, even if a heat-treated steel having a high strength is obtained by utilizing a heating temperature which provides a maximum hardness, fatigue resistance is impaired by carbides which are present in an undissolved state, and it is sometimes not possible to obtain good fatigue resistance which matches the high strength. In addition, even if it is attempted to obtain a high-strength heat-treated steel material by utilizing the heating temperature which results in a maximum hardness, due to dissolving of carbides in solid solution taking place inadequately during the heating step, the actual hardenability is sometimes low. In this case, since the strength after quench hardening is easily affected by the cooling rate, and due to differences in the cooling rate at different locations in the same steel material caused by the shape of the steel material or the state of contact between the steel material and the dies during cooling, the strength may markedly vary from location to location within the same heat-treated steel material.

In hot three-dimensional bending and direct quench, the cooling rate is relatively high due to using water cooling, for example. Therefore, even if differences in the cooling rate develop from one location to another with the same steel material, the cooling rate at each location is sufficiently high, and marked fluctuations in the strength from one location to another within the same heat-treated steel material do not tend to develop. However, since it becomes difficult to achieve good toughness by utilizing the self tempering effect, toughness exhibited after quench hardening is easily affected by nonuniformity of the steel structure. Therefore, there is a large difference between the heating temperature necessary to obtain a high strength and the heating temperature necessary to obtain good toughness. As a result, even if a high-strength heat-treated steel material is obtained by utilizing a heating temperature suitable for obtaining a maximum hardness, toughness becomes poor due to carbides present in an undissolved state, and it is sometimes impossible to obtain good toughness.

Thus, in materials for hot press working with a relatively low cooling rate at the time of quench hardening, it is desired to obtain good fatigue resistance of a level matching its high strength and to suppress fluctuations in strength from one location to another within the same heat-treated steel material even when differences in the cooling rate develop from one location to another within the same steel material. In a material for hot three-dimensional bending and direct quench having a relatively high cooling rate at the time of quench hardening, there is a desire for a decreased difference between the heating temperature necessary to obtain a high strength and the heating temperature necessary to obtain good toughness.

The present inventors carried out further detailed investigations with the object of solving these new problems. At this time, they considered cases in which preforming is carried out on a steel material before it is subjected to hot press working or hot three-dimensional bending and direct quench. They also investigated how to improve the formability of a steel material before quench hardening.

As a result, they focused on the shape of carbides in a steel structure, and they discovered a new technical concept which has not been studied at all in the prior art. This concept is that there is a suitable spheroidization ratio in order to allow carbides to rapidly dissolve into solid solution even when short time heating is carried out at a low temperature while achieving good formability before quench hardening In the prior art, spheroidization treatment of carbides, which was carried out in order to improve the formability of a steel material before quench hardening, was aimed at achieving complete spheroidization of carbides (with a spheroidization ratio of 100%).

The present invention is based on the above-described technical concept and on the following new findings.

Namely, a steel material which is subjected to quench hardening typically contains alloying elements such as Mn which is capable of improving the hardenability of steel.

Substitutional alloying elements such as Mn tend to easily concentrate in spheroidized carbides. Carbides in which substitutional alloying elements such as Mn are concentrated show delayed dissolution to form a solid solution during the heating step at the time of quench hardening, so dissolving of the carbides becomes inadequate when short time heating is performed at a low temperature. As a result, since undissolved carbides remain, the steel structure is not made uniform to an adequate degree, and the actual hardenability sometimes decreases. If an upper limit is set on the spheroidization ratio of carbides, dissolving of carbides into solid solution during the heating step at the time of quench hardening is promoted. As a result, dissolving of carbides rapidly progresses even when short time heating is carried out at a low temperature, and it is possible to increase the actual hardenability. On the other hand, if a lower limit is set on the spheroidization ratio of carbides, it is possible to obtain good formability of a steel material before quench hardening.

As stated below, in the present invention the steel material sometimes contains B, which has the effect of increasing the toughness and hardenability of a steel material. Promotion of dissolving of carbides into solid solution during the heating step at the time of quench hardening is also very effective in order to allow the above-described effect of B to adequately exhibit. This is because the above-described effect of B is exhibited when B is present in steel in solid solution, but B easily forms carbides and tends to be present in carbides. Accordingly, by promoting dissolution of carbides into solid solution during the heating step at the time of quench hardening, the proportion of B present in the form of solid solution in steel is increased, and the above-described effect of B is adequately exhibited.

The present invention is a steel material which has a chemical composition comprising, in mass percent, C: 0.05-0.35%, Si: at most 0.5%, Mn: 0.5-2.5%, P: at most 0.03%, S: at most 0.01%, sol. Al: at most 0.1%, N: at most 0.01%, B: 0-0.005%, Ti: 0-0.01%, Cr: 0-0.5%, Nb: 0-0.1%, Ni: 0-1.0%, and Mo: 0-0.5% and which has a steel structure which contains carbides, wherein the spheroidization ratio of the carbides is 0.60-0.90.

The spheroidization ratio of carbides means the proportion of carbides having an aspect ratio of at most 3. Specifically, it is determined as the ratio of the number of carbides having an aspect ratio of at most 3 to the number of carbides for which the their aspect ratio was determined by the below-described method. For the below-described reason, the aspect ratio is determined for carbides having a particle diameter of at least 0.2 μm.

Preferred embodiments of the present invention include:

- the above-described chemical composition contains at least one element selected from the group consisting of B: 0.0001-0.005%, Ti: 0.01-0.1%, Cr: 0.18-0.5%, Nb: 0.03-0.1%, Ni: 0.18-1.0%, and Mo: 0.03-0.5%;
- the number density of the carbides is at least 0.50 carbides per $\mu m^2$;
- the proportion of the number of coarse carbides having a particle diameter of at least 0.5 μm in the carbides is at most 0.15; and
- at least a portion of the surface of the steel material has a zinc-based plating or coating formed thereon.

The present invention also relates to a heat-treated steel material made from the above-described steel material which has been subjected to hot press working or hot three-dimensional bending and direct quench, and to a method of manufacturing a heat-treated steel material by subjecting the above-described steel material to hot press working or hot three-dimensional bending and direct quench.

A steel material according to the present invention (the material before heat treatment) has the properties that it can be quench-hardened sufficiently to manufacture a formed article of high strength by short time heating at a low temperature and hence it is suitable as a material for hot press working or hot three-dimensional bending and direct quench.

When the steel material is a galvanized steel material, during manufacture of a heat-treated steel material by hot press working or hot three-dimensional bending and direct quench, it is possible to have a larger amount of zinc-based plating or coating remain on the surface of the resulting heat-treated steel material than in the prior art. As a result, it is possible to manufacture a heat-treated steel material having good corrosion resistance.

When the steel material is an unplated steel material, scale which is formed on the surface of a heat-treated steel material obtained by hot press working or hot three-dimensional bending and direct quench can be made restrained to a low level, so it is possible to decrease the costs necessary for descaling in a subsequent step.

In the case of automotive parts, suitable location to which a heat-treated steel material according to the present invention is applied are preferably those locations where a decrease in vehicle weight can be achieved by increasing the strength of the material, such as pillars, door beams, roofs, and bumper reinforcements, for example.

EMBODIMENTS OF THE INVENTION

Figure 1:
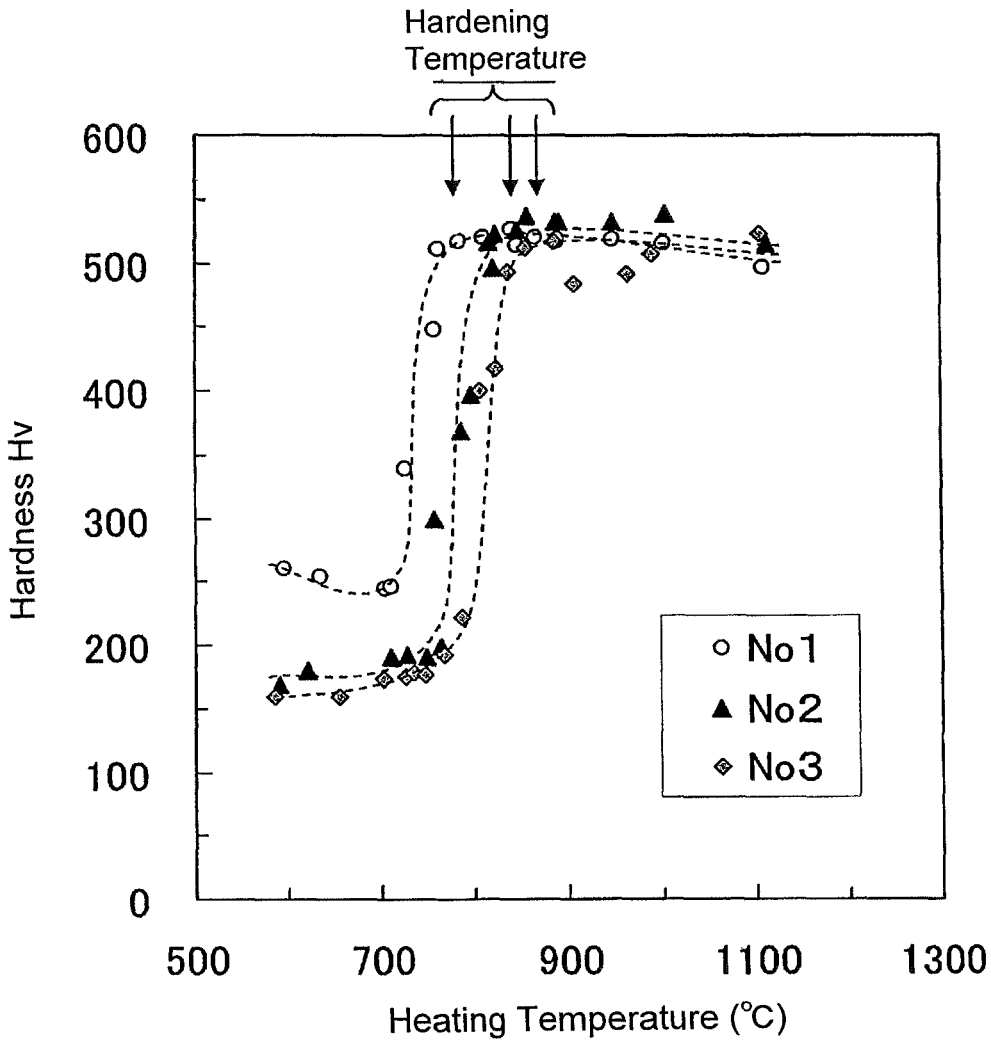
FIG. 1 is a graph showing the relationship between the cross sectional hardness and the heating temperature for the steel sheets of Samples Nos. 1-3 in the example.

The chemical composition and steel structure of a steel material according to the present invention will be explained. In the following explanation, percent with respect to the chemical composition of steel means mass percent.

(1) Chemical Composition

[C: 0.05-0.35%]

C is an important element which determines the strength of a steel material after quench hardening. If the C content is less than 0.05%, a sufficient strength is not obtained after quench hardening Accordingly, the C content is made at least 0.05%. Preferably, it is at least 0.1% and more preferably at least 0.15%. If the C content exceeds 0.35%, there is a marked deterioration in toughness and resistance to delayed fracture of a steel material after quench hardening. In addition, there is a marked deterioration in the formability of a steel material before quench hardening, which is not desirable when carrying out preforming of a steel material prior to hot press working or hot three-dimensional bending and direct quench. Accordingly, the C content is made at most 0.35%. Preferably it is at most 0.30%.

[Si: at most 0.5%]

Si is generally contained as an impurity, but it has the effect of increasing the hardenability of a steel material, so it may be deliberately added. However, if the Si content exceeds 0.5%, there is a marked increase in the $Ac_3$ point of the steel and it becomes difficult to decrease the heating temperature at the time of quench hardening. Furthermore, the ability of a steel material to undergo chemical conversion treatment and the platability when manufacturing a galvanized steel material markedly worsen. Accordingly, the Si content is made at most 0.5%. Preferably it is at most 0.3%. In order to obtain the above-described effect of Si more effectively, the Si content is preferably made at least 0.1%.

[Mn: 0.5-2.5%]

Mn has the effect of lowering the $Ac_3$ point and increasing the hardenability of a steel material. If the Mn content is less than 0.5%, it is difficult to obtain the above effect. Accordingly, the Mn content is made at least 0.5%. Preferably it is at least 1.0%. If the Mn content exceeds 2.5%, there is marked deterioration in the formability of the steel material before quench hardening, which is not desirable when a steel material is subjected to preforming before hot press working or hot three-dimensional bending and direct quench. Furthermore, it becomes easy for a band structure caused by segregation of Mn to develop, resulting in a marked decrease in the toughness of the steel material. Accordingly, the Mn content is made at most 2.5%. Preferably it is at most 2.0%.

[P: at most 0.03%]

P is contained as an impurity. P has the effects of deteriorating the formability of a steel material before quench hardening and deteriorating the toughness of a steel material after quench hardening. Accordingly, the P content is preferably as low as possible and is made at most 0.03% in the present invention. Preferably it is at most 0.015%.

[S: at most 0.01%]

S is contained as an impurity. S has the effects of deteriorating the formability of a steel material before quench hardening and deteriorating the toughness of a steel material after quench hardening. Accordingly, the S content is preferably as low as possible and is made at most 0.01% in the present invention. Preferably it is at most 0.005%.

[sol. Al: at most 0.1%]

Al is generally contained as an impurity, but it has the effect of increasing the soundness of a steel material by deoxidation, so it may be deliberately contained. However, if the sol. Al content exceeds 0.1%, there is a marked increase in the $Ac_3$ point of the steel and it becomes difficult to lower the heating temperature at the time of quench hardening. Accordingly, the sol. Al content is made at most 0.1%. Preferably it is at most 0.05%. In order to obtain the above-described effect of Al with greater certainty, the sol. Al content is preferably made at least 0.005%.

[N: at most 0.01%]

N, which is contained as an impurity, has the effect of deteriorating the formability of a steel material before quench hardening. Accordingly, the N content is preferably as low as possible, and in the present invention, it is made at most 0.01%. Preferably, it is at most 0.005%.

The following elements are optional elements which may be contained in a steel material according to the present invention depending upon the situation.

[B: 0-0.005%, Ti: 0-0.1%, Cr: 0-0.5%, Nb: 0-0.1%, Ni: 0-1.0%, and Mo: 0-0.5%]

B, Ti, Cr, Nb, Ni, and Mo are optional elements. They each have the effect of increasing the toughness and hardenability of a steel material. Accordingly, one or more elements selected from this element group may be contained in a steel material according to the present invention.

However, if the B content exceeds 0.005%, the above-described effect saturates, and such B content is disadvantageous from a cost standpoint. Accordingly, when B is contained, its content is made at most 0.005%. In order to obtain the above-described effect of B with greater certainty, the B content is preferably made at least 0.0001%.

When the Ti content exceeds 0.1%, it bonds with C in steel and forms a large amount of TiC. As a result, the amount of C which contributes to increasing the strength of a steel material by quench hardening decreases, and it is sometimes not possible to obtain a high strength in a steel material after quench hardening. Accordingly, when Ti is contained, its content is made at most 0.1%. In order to obtain the above-described effect of Ti with greater certainty, the Ti content is preferably made at least 0.01%.

By bonding with dissolved N in steel to form TiN, Ti has the effects of reducing the amount of dissolved N in steel and increasing the formability of a steel material before quench hardening. In addition, compared to B, Ti preferentially bonds with dissolved N in steel, so it suppresses a decrease in the amount of dissolved B caused by the formation of BN, so the above-described effects of B can be exhibited with greater certainty. Accordingly, Ti and B are preferably contained together.

When the Cr content exceeds 0.5%, there is a marked deterioration in the formability of a steel material before quench hardening, which is undesirable when preforming is carried out on a steel material prior to hot press working or hot three-dimensional bending and direct quench. Accordingly, when Cr is contained, its content is made at most 0.5%. In order to obtain the above-described effect with greater certainty, the Cr content is preferably made at least 0.18%.

If the Nb content exceeds 0.1%, there is a marked deterioration in the formability of a steel material before quench hardening, which is undesirable when carrying out preforming of a steel material before hot press working or hot three-dimensional bending and direct quench. Accordingly, when Nb is contained, its content is made at most 0.1%. In order to obtain the above-described effect with greater certainty, the Nb content is preferably made at least 0.03%.

If the Ni content exceeds 1.0%, there is a marked deterioration in the formability of a steel material before quench hardening, which is undesirable when a steel material is subjected to preforming before hot press working or hot three-dimensional bending and direct quench. Accordingly, when Ni is contained, its content is made at most 1.0%. In order to obtain the above-described effect with greater certainty, the Ni content is preferably made at least 0.18%.

If the Mo content exceeds 0.5%, there is a marked deterioration in the formability of a steel material before quench hardening, which is undesirable when carrying out preforming of a steel material before hot press working or hot three-dimensional bending and direct quench. Accordingly, when Mo is contained, its content is made at most 0.5%. In order to obtain the above-described effect with greater certainty, the Mo content is preferably made at least 0.03%.

(2) Steel Structure

A steel material according to the present invention has a steel structure in is which the spheroidization ratio of carbides is 0.60-0.90. The number density of the carbides is preferably at least 0.50 carbides per $\mu m^2$, and the proportion (fraction) of the number of coarse carbides with a particle diameter of at least 0.5 μm among the total number of the carbides is preferably at most 0.15.

Here, the particle diameter used herein for defining the shape of a carbide means the diameter of the equivalent circle determined from the area of a carbide measured by observing a cross section of the steel material. Carbides which are of interest in the present invention are carbides having a particle diameter of at least 0.2 μm. Such carbides include carbides having a high proportion of metal elements such as cementite or $M_{23}C_6$. Carbides include carbonitrides. Carbides in steel are observed by observing a cross section of a steel material which has undergone etching with picral (a 5% picric acid solution in ethanol). This is because substantially all the particles having a particle diameter of at least 0.2 μm which are revealed by etching with picral can be regarded as carbides.

Carbides which are considered in the present invention are ones having a particle diameter of at least 0.2 μm in order to appropriately evaluate the particle diameter, the spheroidization ratio, and the number density of carbides in steel, and the proportion of coarse carbides in the carbides. This is because, if the magnification when observing carbides is too low, only coarse carbides are evaluated, and it is not possible to properly evaluate the number of fine carbides which rapidly dissolve to form a solid solution in a heating step and thereby contribute to the hardenability of a steel material. On the other hand, if the magnification when observing carbides is too high, the field of observation is small, and only the local condition of carbides is evaluated, thereby making it impossible to appropriately evaluate the effect of carbides on the hardenability of the entire steel material. Accordingly, a magnification of 2000× is suitable when observing carbides, and under such conditions, the lower limit on the particle size of carbides which can be measured with sufficient accuracy is 0.2 μm. Therefore, carbides with a particle diameter of at least 0.2 μm are made the object of measurement.

Measurement of the particle diameter of carbides can be carried out by observing a cross section of a steel material with a scanning electron microscope. A suitable location for observation is on the midway point between the surface and the center of the steel material, the midway point having received an average thermal history. Namely, if the steel material is a steel sheet, it is preferable to observe a cross section at a position ¼ of the sheet thickness from the surface of the cross section of the steel sheet.

The spheroidization ratio which indicates the shape of carbides means the ratio of the number of carbides having an aspect ratio of at most 3 to the number of carbides for which the aspect ratio was calculated. The aspect ratio of the carbides is calculated for the carbides which were observed in order to measure the above-described particle diameter. The aspect ratio is the ratio of the length of the longest axis which can be obtained in a cross section of observed carbide to the length of an axis perpendicular to the longest axis. The spheroidization ratio is determined by observing a cross section of the steel material with an electron microscope at a magnification of 2000× and calculating the aspect ratio of the carbides. The number of fields of observation is preferably at least 2.

From the standpoint of the formability of the steel material before quench hardening, the remainder of the steel structure other than carbides is preferably substantially ferrite. Pearlite, bainite, and tempered martensite are structures comprised of carbides and ferrite. Therefore, a steel structure comprised of carbides and ferrite includes the case in which any of these structures is present. The steel structure also includes inclusions such as MnS and TiN which are unavoidably formed in the case of the above-described chemical composition.

[Spheroidization ratio of carbides: 0.60 -0.90]

As stated above, substitutional alloying elements such as Mn tend to easily concentrate in spheroidized carbides. Carbides in which substitutional alloying elements such as Mn are concentrated have delayed dissolution to form a solid solution in the heating step at the time of quench hardening, and if the short time heating is carried out at a low temperature, dissolution of carbides into a solid solution becomes inadequate, and the problem of inadequate quench hardening easily develops. Accordingly, an upper limit on the spheroidization ratio of carbides is set so that carbides will rapidly dissolve to form a solid solution even when short time heating is carried out at a low temperature and the steel material will be sufficiently quench-hardened with certainty. As a result, dissolving of carbides into solid solution in the heating step at the time of quench hardening can be promoted. Specifically, if the spheroidization ratio of carbides exceeds 0.90, dissolving of carbides to form solid solution by short time heating at a low temperature may become inadequate and quench hardening may be inadequate. Accordingly, the spheroidization ratio of carbides is made at most 0.90. Preferably it is at most 0.87 and more preferably at most 0.85.

As can be understood from the fact that spheroidizing (annealing for spheroidization) of a steel material by holding it in a predetermined high-temperature ranges has been conventionally carried out in order to spheroidize carbides and thereby soften the steel material before quench hardening, it is necessary to increase the spheroidization ratio of carbides to a certain extent in order to increase the formability of the steel material before quench hardening. If the spheroidization ratio of carbides is less than 0.60, there is a marked deterioration in the formability of a steel material before quench hardening, which is undesirable when a steel material undergoes preforming before hot press working or hot three-dimensional bending and direct quench. Accordingly, the spheroidization ratio of carbides is made at least 0.60. Preferably it is at least 0.63 and more preferably it is at least 0.65.

[Number density of carbides: at least 0.50 carbides per $\mu m^2$]

The behavior of the steel structure during a heating step at the time of quench hardening is as follows. Initially austenite nuclei develop by originating from carbides, and then the austenite nuclei grow to achieve complete austenization. Accordingly, if the number density of carbides which serve as starting points for austenite nuclei is increased, the distance of austenite growth needed for complete austenization is shortened, and complete austenization can be achieved at a lower temperature in a shorter length of time. Namely, quench hardening takes place with greater certainty even when short time heating is performed at a low temperature.

By making the number density of carbides (those having a particle diameter of at least 0.2 μm) at least 0.50 carbides per $\mu m^2$, complete austenization in the heating step at the time of quench hardening can be effectively promoted. Accordingly, the number density of carbides is preferably made at least 0.50 carbides per $\mu m^2$. The number density of carbides is more preferably at least 0.60 carbides per $\mu m^2$ and most preferably is at least 0.70 carbides per $\mu m^2$.

[Number proportion of coarse carbides having a particle diameter of at least 0.5 μm in the carbides: at most 0.15]

Compared to fine carbides, coarse carbides have slower dissolution into solid solution in the heating step at the time of quench hardening. Accordingly, if the proportion of number of coarse carbides in the carbides is decreased, dissolution of carbides into solid solution during the heating step at the time of quench hardening is promoted, and quench hardening is carried out with greater certainty even by short time heating at a low temperature.

When the proportion of the number of coarse carbides having a particle diameter of at least 0.50 μm with respect to the total number of the carbides (having a particle diameter of at least 0.2 μm) is at most 0.15, it is possible to effectively promote dissolution of carbides in solid solution in the heating step at the time of quench hardening. Accordingly, the proportion of the number of coarse carbides having a particle diameter of at least 0.5 μm in the carbides is preferably at most 0.15. This number proportion of coarse carbides is more preferably at most 0.14 and most preferably at most 0.13.

Controlling the shape of carbides as described above can be achieved by empirically determining the hot rolling conditions and the annealing conditions for obtaining a desired shape of the carbides and adjusting these conditions. For example, with respect to hot rolling conditions, it is known that if the coiling temperature is increased, spheroidization of carbides is promoted, the number density of carbides decreases, and the number proportion of coarse carbides increases. Based on these qualitative tendencies, the hot rolling conditions for obtaining a desired shape of the carbides can be empirically determined. Concerning annealing conditions, it is known that if the cooling rate is lowered, spheroidization of carbides is promoted, the number density of carbides decreases, and the number proportion of coarse carbides increases. Based on these qualitative tendencies, it is possible to empirically determine the annealing to conditions for obtaining a desired shape of carbides.

(3) Manufacturing Conditions

It is not necessary to particularly limit the manufacturing conditions of a steel material according to the present invention (the material before quench hardening) as long as the above-described chemical composition and the steel structure are satisfied. Below, preferred manufacturing conditions will be explained for the case in which a steel material according to the present invention is a steel sheet.

A steel having the above-described chemical composition is melted in a conventional manner, then it is formed into a slab by continuous casting or into a billet by casting followed by blooming From the standpoint of productivity, it is preferable to use the continuous casting method.

When using the continuous casting method, a casting speed of less than 2.0 meters per minute is preferable because central segregation or V segregation of Mn is effectively suppressed. The casting speed is preferably at least 1.2 meters per minute because good cleanliness of the surface of the casting can be maintained along with good productivity.

Next, the resulting slab or billet is subjected to hot rolling.

Preferable hot rolling conditions from the standpoint of forming carbides more uniformly include starting of hot rolling in a temperature range of at least 1000° C. and at most 1300° C. with the temperature at the completion of hot rolling being at least 850° C. From the standpoint of formability, the coiling temperature is preferably on the high side, but if it is too high, yield decreases due to the formation of scale. A preferable coiling temperature is at least 500° C. and at most 650° C.

The hot rolled steel sheet obtained by hot rolling is subjected to descaling treatment by pickling or the like.

A steel material according to the present invention may be a hot rolled steel sheet which has not undergone annealing, a hot rolled annealed steel sheet which has undergone annealing, a cold rolled steel sheet obtained in an as-cold rolled state by performing cold rolling on the above-described hot rolled steel sheet or hot rolled annealed steel sheet, or a cold rolled annealed steel sheet obtained by annealing the above-described cold rolled steel sheet. The process can be suitably selected in accordance with the required accuracy of the sheet thickness of the product or the like.

Accordingly, a hot rolled steel sheet which has undergone descaling treatment may if necessary be subjected to annealing to obtain a hot rolled annealed steel sheet. A hot rolled steel sheet or a hot rolled annealed steel sheet may if necessary be subjected to cold rolling to obtain a cold rolled steel sheet. A cold rolled steel sheet may if necessary be subjected to annealing to obtain a cold rolled annealed steel sheet. When a steel material to be subjected to cold rolling is hard, annealing is preferably performed prior to cold rolling to increase the formability of the steel material to be subjected to cold rolling.

Carbides are hard, and their shape does not undergone change during cold rolling. Accordingly, the shape of carbides (the particle diameter, the spheroidization ratio, the number density, the number proportion of coarse carbides or the like) in a cold rolled steel sheet in an as-rolled state is substantially the same as the shape of carbides in a steel sheet to be subjected to cold rolling. Thus, control of the shape of carbides in a cold rolled steel sheet in an as-cold rolled state can be carried out by controlling the shape of carbides present in the steel sheet to be subjected to cold rolling. Namely, when cold rolling is carried out on a hot rolled steel sheet which has not been subjected to annealing, it is possible to control the shape of carbides in a cold rolled steel sheet by controlling the hot rolling conditions to control the shape of carbides present in the hot rolled steel sheet. When carrying out cold rolling on a hot rolled annealed steel sheet which has been subjected to annealing, it is possible to control the shape of carbides in a cold rolled steel sheet by controlling the shape of carbides present in the hot rolled annealed steel sheet by controlling the annealing conditions or both the hot rolling conditions and the annealing conditions.

Cold rolling may be carried out in a conventional manner. From the standpoint of guaranteeing good sheet flatness, the rolling reduction in cold rolling is preferably at least 30%. In order to avoid the load becoming excessive, the rolling reduction is preferably at most 80%.

When carrying out annealing of a hot rolled steel sheet or a cold rolled steel sheet, annealing is performed after treatment such as degreasing is carried out if necessary in a conventional manner The soaking (isothermal heating) at this time is preferably carried out at a temperature in the single austenitic phase region. By heating in this manner, the formation of a band structure is suppressed and the steel structure can be made more uniform, leading to a further increase in the hardenability of the steel sheet. After soaking, the average cooling rate from the $Ar_3$ point to the temperature of 200° C. above the Ms point (Ms point+200° C.) is preferably at least 20° C. per second. By cooling in this manner, the formation of a non-uniform steel structure at the time of cooling after soaking is suppressed and the hardenability of the steel sheet can be further increased.

From the standpoint of obtaining a uniform steel structure and the standpoint of productivity, annealing is preferably performed in a continuous annealing line. In this case, annealing is preferably carried out by soaking in a temperature range from at least the $Ac_3$ point to at most ($Ac_3$ point+100° C.) for a period of at least one second to at most 1000 seconds followed by holding in a temperature range from at least 250° C. to at most 550° C. for at least 1 minute to at most 30 minutes.

As is clear to one skilled in the art, the hot rolling conditions and the annealing conditions for obtaining a steel structure which satisfies the conditions on the shape of carbides according to the present invention vary with the chemical composition of the steel material. As stated above, they can be empirically determined.

When the surface of a steel sheet is subjected to galvanizing (zinc-based plating), from the standpoint of productivity, it is preferable to carry out hot-dip galvanizing using a continuous hot-dip galvanizing line. In this case, annealing may be carried out in the continuous hot-dip galvanizing line prior to hot-dip galvanizing, or the soaking temperature can be set to a low level and just galvanizing can be carried out without performing annealing. It is also possible to carry out heat treatment for alloying after hot-dip galvanizing to obtain a galvannealed steel sheet. Galvanizing can also be carried out by electroplating.

Some examples of galvanizing are hot-dip zinc plating, galvannealing, zinc electroplating, hot-dip zinc-aluminum alloy plating, nickel-zinc alloy electroplating, and iron-zinc alloy electroplating. There is no particular limitation on the plating weight, and it may be a conventional value. Galvanizing can be carried out on at least a portion of the surface of a steel material, but in the case of a steel sheet, it is normally carried out on the entirety of one or both surfaces of the sheet.

A steel sheet according to the present invention which is manufactured as described above has high hardenability, and it can be sufficiently hardened to give a high strength by quench hardening for short time heating and/or at a low temperature. Accordingly, (i) it can if necessary be divided into small pieces and subjected to hot press working to obtain formed articles, or (ii) it can undergo suitable working to obtain a material for hot three-dimensional bending and direct quench, and hot three-dimensional bending and direct quench can be carried out to obtain a formed article. Alternatively, it can simply undergo quench hardening without being worked.

Hot press working and hot three-dimensional bending and direct quench can be carried out by known methods. In order to achieve the effects of the present invention, a heating step is preferably carried out for a short period of time. Therefore, rapid heating by high frequency heating or resistance heating is preferably used.

The above explanation is for the case in which a steel material before quench hardening is a steel sheet. However, a steel material is not limited to a steel sheet, and it may be a tube, a rod, a profile, or the like. It may be an elongated member or it may be a cut material which has cut from an elongated member and optionally undergone preforming.

EXAMPLE 1

After continuously cast slabs of steels A-I having the chemical compositions shown in Table 1 were each charged into a heating furnace, heated therein, and extracted from the heating furnace, they were each hot rolled starting at 1150° C. and finishing at 870° C., cooled at an average cooling rate of 20-1000° C. per second, and coiled at a temperature of 450-600° C. to obtain hot rolled steel sheets having a thickness of 3.6 mm. The resulting hot rolled steel sheets were descaled by pickling. The steel sheets obtained in this manner will be referred to as hot rolled materials.

A portion of the descaled hot rolled steel sheets underwent cold rolling with a rolling reduction of 50% to obtain cold rolled steel sheets. These steel sheets will be referred to as full hard materials.

A portion of the resulting cold rolled steel sheets were held for 20 hours at 650° C. in a heating furnace and then air cooled to room temperature. These steel is sheets will be referred to as furnace-heated materials.

A separate portion of the cold rolled steel sheets were heat treated using a continuous annealing simulator in which they were soaked for 1 minute at a temperature of 750-900° C., then cooled at an average cooling rate in the region of from 650° C. to 450° C. of 10-200° C. per second, then held for 4 minutes at 420° C., and cooled to room temperature. These steel sheets will be referred to as continuously annealed materials.

TABLE 1

| | Chemical Composition (unit: mass %; remainder: Fe and impurities) | | | | | | | | | | | | |
|---|---|---|---|---|---|---|---|---|---|---|---|---|---|
| Steel | C | Si | Mn | P | S | sol. Al | N | B | Ti | Cr | Nb | Ni | Mo |
| A | 0.21 | 0.25 | 1.30 | 0.014 | 0.003 | 0.04 | 0.003 | 0.0014 | 0.024 | 0.25 | | | |
| B | 0.20 | 0.20 | 1.20 | 0.010 | 0.004 | 0.03 | 0.005 | | | | | | |
| C | 0.21 | 0.25 | 1.25 | 0.012 | 0.003 | 0.04 | 0.004 | 0.0010 | 0.025 | | | | |
| D | 0.22 | 0.20 | 0.75 | 0.013 | 0.002 | 0.05 | 0.004 | 0.0014 | 0.023 | 0.30 | 0.08 | | |
| E | 0.30 | 0.25 | 1.70 | 0.012 | 0.003 | 0.03 | 0.003 | 0.0014 | 0.024 | 0.20 | 0.07 | | |
| F | 0.25 | 0.25 | 1.30 | 0.010 | 0.004 | 0.04 | 0.004 | 0.0014 | 0.020 | 0.35 | | 0.2 | 0.1 |
| G | 0.21 | 1.20 | 1.05 | 0.010 | 0.003 | 0.03 | 0.003 | | | | | | |
| H | 0.20 | 0.20 | 1.10 | 0.014 | 0.003 | 0.80 | 0.004 | | | | | | |
| I | 0.15 | 0.30 | 0.70 | 0.014 | 0.003 | 0.04 | 0.004 | | | | | | |

Underlined figures are outside the range defined herein.

The steel sheets of Samples Nos. 1-22 shown in Table 2 (sheet thickness of 1.8 mm) were manufactured in the above-described manner. For the same steel type, the hot rolling conditions and the annealing conditions (in the case of the continuously annealed materials) varied among the samples. The hot rolled materials underwent grinding of both surfaces of the hot rolled steel sheets to reduce their thickness from 3.6 mm to 1.8 mm so as to have the same sheet thickness as other samples.

The steel sheets of Samples Nos. 1-22 underwent hot-dip zinc plating followed by alloying treatment in a temperature range no higher than the $A_1$ point so that the shape of the carbides would not change to obtain galvannealed steel sheets of Samples Nos. 1-22.

The structure of the cross section of the steel sheets of Samples Nos. 1-22 which were obtained in the above-described manner was observed at four fields of view for each sheet at a magnification of 2000× using a scanning electron microscope to determine the spheroidization ratio, number density of carbides, and the number proportion of coarse carbides. The field of view was located at a depth of 0.45 mm from the surface of the steel sheet, which dimension corresponded to ¼ the sheet thickness of 1.8 mm The carbide particles were observed by etching with picral (a 5% picric acid solution in ethanol). The total number of carbides observed in each field of view was 300-3000. As for pearlite, each cementite contained in pearlite lamella was counted as one carbide.

Using a quench hardening simulator, the steel sheets of Samples Nos. 1-22 were each subjected to quench hardening by heating to temperatures in the range of 600-1100° C. at a rate of 500° C. per second and immediately after the predetermined temperature was reached, performing water cooling. The Vickers hardness (Hv) after quench hardening was measured. As shown in FIG. 1, the lowest temperature which gave the maximum hardness (the lowest quench hardening temperature) was measured.

The galvannealed steel sheets of Samples Nos. 1-22 were each subjected to quench hardening by heating to the lowest quench hardening temperature at a rate of 500° C. per second followed by water cooling after the lowest quench hardening temperature was reached. Based on the phenomenon that oxidation of zinc is accompanied by the formation of zinc oxide which is white, the degree of whiteness of the surface of the galvannealed steel material was visually observed to evaluate the extent to which a plating layer remained. The plating quality was evaluated by the following standard:

A) nearly completely remaining; B) acceptable level; C) small amount remaining; and D) almost none remaining.

Separately, using a quench hardening simulator, the steel sheets of Samples Nos. 1-22 were each heated at a rate of 500° C. per second to the above-described lowest quench hardening temperature, held at that temperature for 3 seconds and then water cooled. The thickness of scale which formed on the surface of the steel to sheets was measured.

Figure 2:
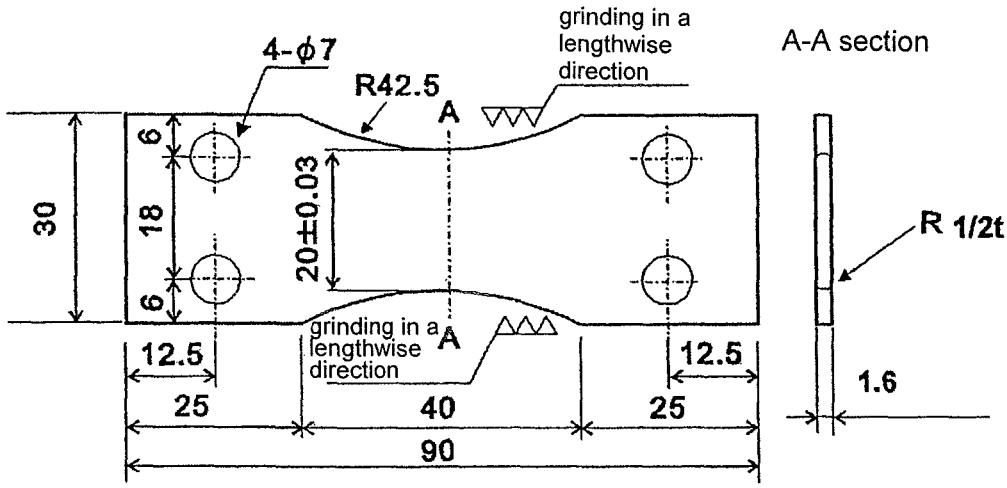
FIG. 2 shows the shape of a fatigue test piece.
Figure 3:
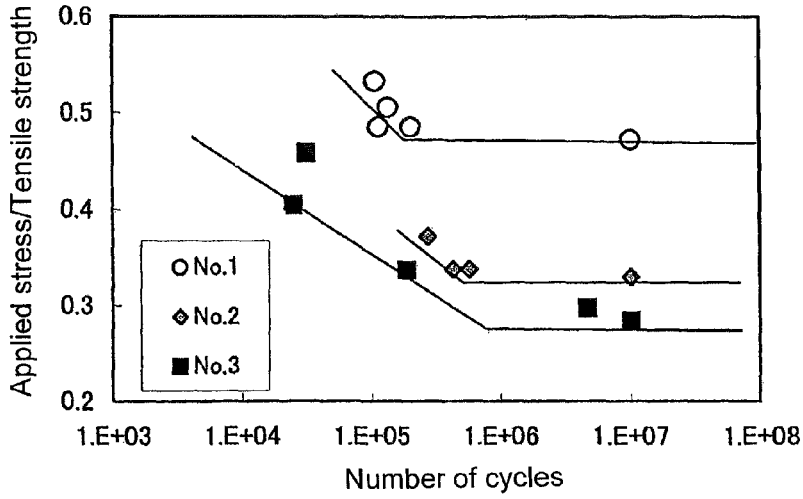
FIG. 3 shows an S-N curve for a heat-treated steel material which has undergone hot press working by sandwiching the steel sheets of Samples No. 1-3 in the example between a pair of flat dies.

In addition, the steel sheets of Samples Nos. 1-22 were each subjected to hot press forming by holding for 4 minutes at 900° C. followed by sandwiching between a pair of flat dies. A tensile test was carried out on a JIS No. 5 tensile test piece taken from each hot press formed steel sheet to determine the tensile strength. In addition, a fatigue test with planar bending (R=−1) was carried out on a fatigue test piece as shown in FIG. 2 which was taken from each hot press formed steel sheet, and an S-N curve as shown in FIG. 3 was prepared to determine the fatigue limit. The fatigue limit ratio (the fatigue limit divided by the tensile strength) was calculated.

Figure 4:
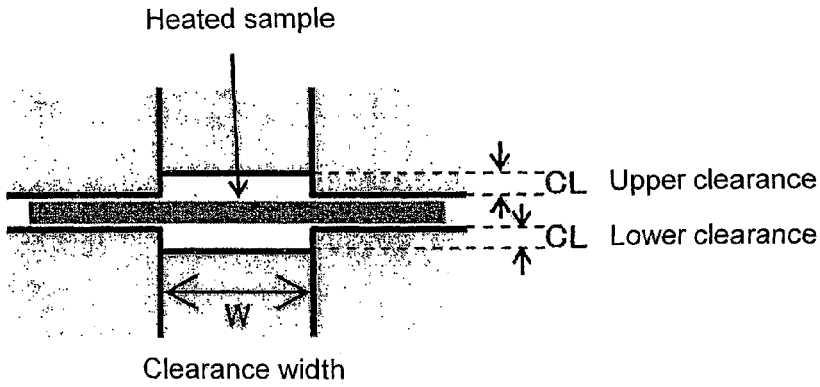
FIG. 4 schematically shows hot press working using split dies.
Figure 5:
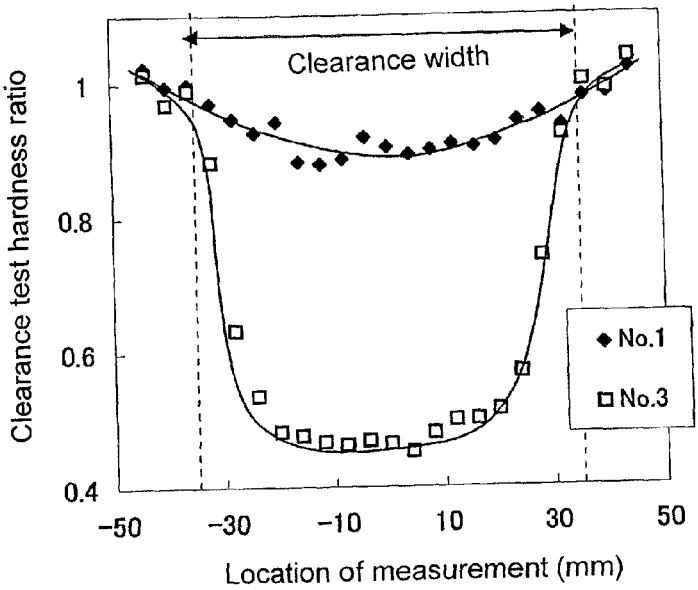
FIG. 5 is a graph showing the cross sectional hardness for a heat-treated steel material which has undergone hot press working by sandwiching the steel sheets of Samples Nos. 1 and 3 of the example in split dies.

Separately, test pieces measuring 200 mm long and 50 mm wide were taken from the steel sheets of Samples Nos. 1-22, and they were subjected to hot press working by holding for 1.5 minutes at 900° C. followed by sandwiching the test pieces between split dies as shown in FIG. 4. At this time, the clearance width was made 70 mm and the upper and lower clearances were each 0.2 mm. Holding at the bottom dead center was carried out for 60 seconds with a pressing force of 49 kN. As shown in FIG. 5, the cross sectional hardness (Hv) of the steel sheets which were obtained by this hot press working was measured and the ratio of the smallest hardness in the clearance center to the average hardness of firmly contacted portions other than the clearance (the clearance test hardness ratio) was determined.

Figure 6:
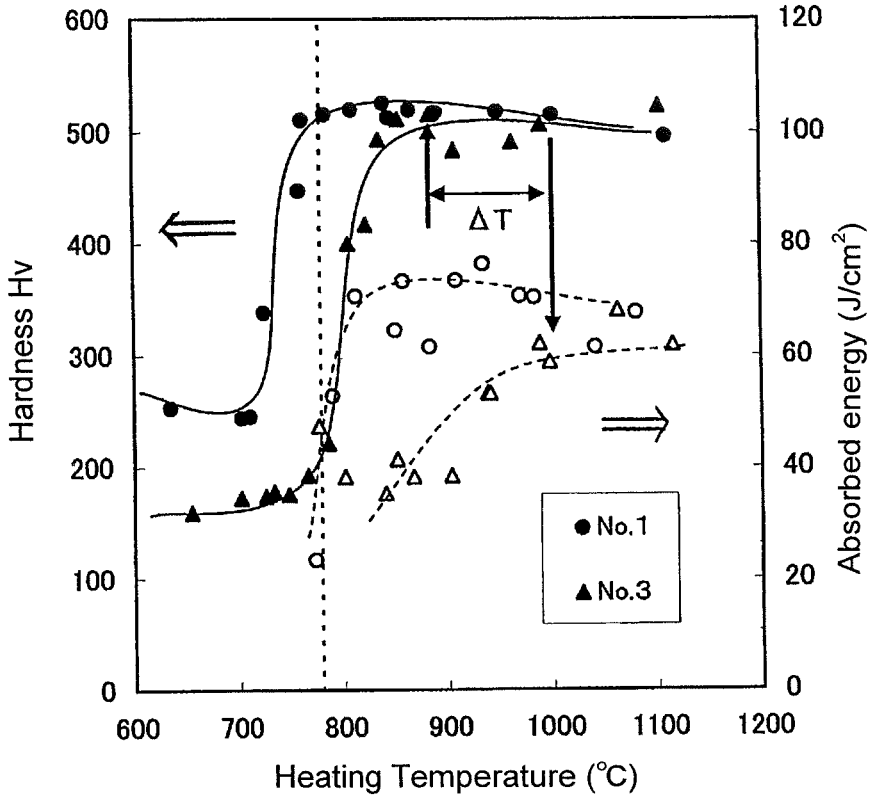
FIG. 6 is a graph showing, for the steel sheets of Samples Nos. 1 and 3 in the example, the relationship of the heating temperature with the cross sectional hardness (shown by ● and ▲, respectively, in the figure) and with the absorbed energy in an impact test (shown by ○ and Δ, respectively, in the figure).

Using a quench hardening simulator, the steel sheets of Samples Nos. 1-22 were each subjected to quench hardening by heating to temperatures in the range of 600 -1100° C. at a rate of 500° C. per second and after they reached the predetermined temperature performing water cooling. As shown in FIG. 6, the lowest temperature achieving the maximum hardness (lowest quench hardening temperature) and the temperature achieving the maximum absorbed energy were determined, and the difference ΔT between the temperature achieving the highest absorbed energy and the lowest temperature achieving the highest hardness was determined (shown by ΔT for Sample No. 3 in FIG. 6). The absorbed energy was determined by grinding test pieces obtained from the steel sheets to a thickness of 1.4 mm, stacking three test pieces on top of each other, and carrying out a 2-mm V-notched Charpy test on the stacked test pieces at room temperature. The to smaller the ΔT, the more preferable. This is because a smaller ΔT indicates that a sufficiently high toughness can be obtained by quench hardening at a lower temperature which is closer to the lowest quench hardening temperature.

The results of the above measurements are shown in Table 2.

TABLE 2

| No. | Steel | Process | Spheroidization ratio of carbides | Number desityof carbides per μm² | Number proportion of coarse carbides | Lowest qunch hardening temp. (° C.) | Plating quality at lowest hardening temp. | Scale thickness at lowest hardening temp. (μm) | Fatigue limit ratio | Clearannce test hardness ratio | ΔT (° C.) | |
|---|---|---|---|---|---|---|---|---|---|---|---|---|
| 1 | A | Continuously annealed | 0.81 | 1.00 | 0.07 | 784 | A | 3.5 | 0.47 | 0.90 | 24 | Invent. |
| 2 | | Hot rolled | 0.52 | 0.45 | 0.31 | 862 | C | 6.5 | 0.33 | 0.60 | 74 | Compar. |
| 3 | | Furnace heated | 0.95 | 0.42 | 0.17 | 892 | D | 7.7 | 0.25 | 0.43 | 108 | Compar. |
| 4 | | Hot rolled | 0.65 | 0.79 | 0.11 | 822 | B | 4.6 | 0.37 | 0.67 | 36 | Invent. |
| 5 | | Continuously annealed | 0.55 | 0.34 | 0.25 | 888 | D | 7.3 | 0.25 | 0.42 | 69 | Compar. |
| 6 | B | Continuously annealed | 0.84 | 0.91 | 0.09 | 809 | B | 3.9 | 0.41 | 0.71 | 32 | Invent. |
| 7 | | Furnace heated | 0.93 | 0.42 | 0.20 | 907 | D | 8.8 | 0.24 | 0.43 | 99 | Compar. |
| 8 | C | Full hard | 0.63 | 0.82 | 0.13 | 812 | B | 4.7 | 0.39 | 0.68 | 37 | Invent. |
| 9 | | Hot rolled | 0.50 | 0.45 | 0.33 | 876 | C | 7.4 | 0.27 | 0.48 | 80 | Compar. |
| 10 | D | Continuously annealed | 0.79 | 0.95 | 0.09 | 810 | B | 4.5 | 0.42 | 0.75 | 28 | Invent. |
| 11 | | Hot rolled | 0.45 | 0.31 | 0.25 | 906 | D | 8.5 | 0.23 | 0.40 | 87 | Compar. |
| 12 | | Furnace heated | 0.96 | 0.28 | 0.31 | 935 | D | 10.2 | 0.21 | 0.34 | 105 | Compar. |
| 13 | E | Continuously annealed | 0.68 | 0.71 | 0.12 | 803 | B | 4.4 | 0.38 | 0.67 | 34 | Invent. |

TABLE 2-continued

| No. | Steel | Process | Spheroidization ratio of carbides | Number desityof carbides per μm² | Number proportion of coarse carbides | Lowest qunch hardening temp. (° C.) | Plating quality at lowest hardening temp. | Scale thickness at lowest hardening temp. (μm) | Fatigue limit ratio | Clearannce test hardness ratio | ΔT (° C.) | |
|---|---|---|---|---|---|---|---|---|---|---|---|---|
| 14 | | Furnace heated | 0.92 | 0.44 | 0.21 | 873 | C | 6.5 | 0.27 | 0.45 | 120 | Compar. |
| 15 | F | Continuously annealed | 0.78 | 0.95 | 0.08 | 789 | A | 3.0 | 0.45 | 0.81 | 27 | Invent. |
| 16 | | Hot rolled | 0.45 | 0.38 | 0.40 | 874 | C | 6.2 | 0.27 | 0.48 | 78 | Compar. |
| 17 | G | Continuously annealed | 0.53 | 0.60 | 0.16 | 902 | D | 8.6 | 0.26 | 0.42 | 45 | Compar. |
| 18 | | Hot rolled | 0.41 | 0.41 | 0.25 | 931 | D | 10.5 | 0.22 | 0.35 | 80 | Compar. |
| 19 | H | Continuously annealed | 0.76 | 0.95 | 0.10 | 875 | C | 7.2 | 0.30 | 0.50 | 35 | Compar. |
| 20 | | Hot rolled | 0.44 | 0.36 | 0.23 | 963 | D | 12.2 | 0.18 | 0.32 | 78 | Compar. |
| 21 | I | Continuously annealed | 0.55 | 0.42 | 0.19 | 914 | D | 8.9 | 0.23 | 0.40 | 65 | Compar. |
| 22 | | Hot rolled | 0.35 | 0.21 | 0.28 | 946 | D | 11.7 | 0.20 | 0.32 | 88 | Compar. |

Underlined figures are outside the range defined herein

As shown in Tables 1 and 2 and FIGS. 1, 3, 5, and 6, the steel sheets of the inventive examples have a lowest quench hardening temperature which is lower than that of the steel sheets of the comparative examples of the same steel types, indicating that a high hardness can be obtained even by short time heating at a low temperature. In addition, for galvannealed steel sheets, even if heating is carried out at the lowest quench hardening temperature, a considerable amount of a plated layer can be maintained. For unplated steel sheets, even if heating is carried out at the lowest quench hardening temperature, the thickness of scale can be made a low value of at most 5 μm. The fatigue limit ratio in hot press working is a high value of at least 0.35, and the clearance test hardness ratio is also a high value of at least 0.65. ΔT is a low value of 35° C. or less.

The invention claimed is:

1. A steel material which has a chemical composition comprising, in mass percent, C: 0.05-0.35%, Si: at most 0.5%, Mn: 0.5-2.5%, P: at most 0.03%, S: at most 0.01%, sol. Al: at most 0.1%, N: at most 0.01%, B: 0-0.005%, Ti: 0-0.1%, Cr: 0-0.5%, Nb: 0-0.1%, Ni: 0-1.0%, and Mo: 0-0.5%, and which has a steel structure containing carbides, with the spheroidization ratio of the carbides being 0.60-0.90, a number density of the carbides being at least 0.50 carbides per μm², and the proportion of the number of coarse carbides having a particle diameter of at least 0.5 μm in the carbides is at most 0.15.

2. A steel material as set forth in claim 1 wherein the chemical composition contains at least one element selected from the group consisting of B: 0.0001-0.005%, Ti: 0.01-0.1%, Cr: 0.18-0.5%, Nb: 0.03-0.1%, Ni: 0.18-1.0%, and Mo: 0.03-0.5%.

3. A steel material as set forth in claim 1 wherein the steel material has a surface having a zinc-based plated layer on at least a portion thereof.

4. A heat-treated steel material made from a steel material as set forth in claim 1 which has undergone hot press working.

5. A heat-treated steel material made from a steel material as set forth in claim 1 which has undergone hot three-dimensional bending and direct quench.

6. A method of manufacturing a heat-treated steel material comprising carrying out hot press working on a steel material as set forth in claim 1.

7. A method of manufacturing a heat-treated steel material comprising carrying out hot three-dimensional bending and direct quench on a steel material as set forth in claim 1.

8. A steel material as set forth in claim 1 wherein the chemical composition contains B: 0.0001 to 0.005%.

9. A steel material as set forth in claim 1 wherein the spheroidization ratio of the carbides is 0.60 to 0.78.

10. A steel material as set forth in claim 1 wherein the chemical composition contains Mn: 1.0 to 2.5% and C: 0.05 to 0.30%.

11. A steel material, which is subjected to hot press working or hot three-dememsional bending and direct quench and has a chemical composition comprising, in mass percent, C: 0.05-0.35%, Si: at most 0.5%, Mn: 0.5-2.5%, P: at most 0.03%, S: at most 0.01%, sol. Al: at most 0.1%, N: at most 0.01%, B: 0-0.005%, Ti: 0-0.1%, Cr: 0-0.5%, Nb: 0-0.1%, Ni: 0-1.0%, and Mo: 0-0.5%, and which has a steel structure containing carbides, with the spheroidization ration of the carbides being 0.60-0.90, a number density of the carbides being at least 0.50 carbides per μm², and the proportion of the number of coarse carbides having a particle diameter of at least 0.5 μm in the carbides is at most 0.15.

* * * * *